US005660503A

United States Patent [19]

Lewis

[11] Patent Number: 5,660,503

[45] Date of Patent: Aug. 26, 1997

[54] LIGHT WEIGHT SCUBA WITH BUOYANCY CONTROL

[76] Inventor: R. David Lewis, 1341 Smokerise La., Auburn, Ga. 30203

[21] Appl. No.: 586,938

[22] Filed: Jan. 11, 1996

[51] Int. Cl.[6] ..... B63C 11/02

[52] U.S. Cl. ..... 405/186; 441/114; 441/96; 224/934

[58] Field of Search ..... 405/185, 186; 224/934; 441/96, 114

[56] References Cited

U.S. PATENT DOCUMENTS

| | | | |
|---|---|---|---|
| 3,969,812 | 7/1976 | Beck | 29/421 R |
| 4,009,583 | 3/1977 | Buckle | 405/186 |
| 4,054,132 | 10/1977 | Deeds | 441/96 |
| 4,062,356 | 12/1977 | Merrifield | 224/934 |
| 4,671,831 | 6/1987 | Mohan | 156/69 |

FOREIGN PATENT DOCUMENTS

| | | | |
|---|---|---|---|
| 2651203 | 3/1991 | France | 405/186 |
| 1284587 | 8/1972 | United Kingdom | 441/114 |

*Primary Examiner*—Tamara L. Graysay
*Assistant Examiner*—Frederick L. Lagman
*Attorney, Agent, or Firm*—James B. Middleton

[57] ABSTRACT

Scuba apparatus utilizes light-weight pressure vessels, or tanks, of relatively thin aluminum wrapped with fiber in a resin binder. Since such tanks are not approved for use in water, the tanks are enclosed within a water tight enclosure, and the enclosure in pressurized to exclude all water. A connection for filling the tanks extends through the enclosure, a burst disk is provided externally of the enclosure, and connections for the scuba mask and other accessories are provided. An automatically adjusting buoyancy control may be included within the enclosure in space not occupied by the tanks. A container fits within the void, and a flexible bladder is within the container. Water can be allowed to flow into the bladder, and air under pressure fills the balance of the container and balances ambient pressure. The size of the container cannot change, and the amount of water remains fixed, so the buoyancy remains fixed.

9 Claims, 2 Drawing Sheets

LIGHT WEIGHT SCUBA WITH BUOYANCY CONTROL

BACKGROUND OF THE INVENTION

1. Field of the Invention

This invention relates generally to scuba gear, and is more particularly concerned with light weight scuba gear having an automatic buoyancy control.

2. Discussion of the Prior Art

Self contained breathing apparatus is well known in the art. Such apparatus has been well developed for use under water, and the development and use have been extended to numerous environments including the smoke and gas filled atmosphere of fire fighting, and the gas filled atmosphere of chemical processing, gas leaks and the like. Since the apparatus is to be carried by a person, it is of course desirable to have the apparatus as light in weight as possible without undue sacrifice of air capacity. Thus, there has been developed a light-weight pressure vessel for use in smoke, chemical and similar environments. The light-weight pressure vessels comprise relatively thin-walled aluminum cylinders wrapped with fibers, the fibers being embedded in a binder resin such as epoxy. These light-weight pressure vessels are capable of withstanding higher pressures than the usual aluminum cylinders, so they can hold a greater quantity of air. The disadvantage of the light-weight pressure vessels is that, because of concern about long-term compatibility with water, the United States Department of Transportation has not approved fiber wrapped pressure vessels for underwater use. Thus, scuba gear has been unable to take advantage of such vessels, or "tanks" as they are called in scuba application.

Scuba gear typically includes a buoyancy adjusting means so that, once a diver is in the water, the diver's buoyancy can be adjusted to neutral so it will be easy for the diver to move up or down in the water. Of course, the buoyancy can be adjusted to increase the buoyancy for a diver to rise from the depths. The problem with the conventional buoyancy control is that the high pressure at great depths compresses the air in the buoyancy control device and makes the device smaller, thereby decreasing the amount of buoyancy. Conversely, when the diver rises in the water, the lower ambient pressure allows the buoyancy device to expand, thereby increasing the amount of buoyancy. As a result, the diver must continually adjust the air in the buoyancy device in order to retain the desired neutral buoyancy.

SUMMARY OF THE INVENTION

The present invention provides at least one light-weight pressure vessel, or air tank, within an enclosure to the air tank is not exposed to water. The enclosure is pressurized so that water will be excluded from even microscopic holes or the like in the enclosure. By this arrangement, scuba gear can utilize the higher capacity, light-weight air tanks.

In a preferred embodiment of the invention the enclosure includes two or more light-weight tanks. Considering the higher pressures the light-weight tanks can withstand, the plurality of tanks will contain a greater volume of air than conventional scuba tanks, but the weight of the entire apparatus will be considerably less than the weight of conventional scuba gear.

The enclosure for the light-weight tanks may include a buoyancy compensator therein. A container within the enclosure has a flexible bladder therein, the interior of the bladder being selectively in communication with the water through a valve. The interior of the container communicates through valve means with the air supply, and with the environment. As a result, the bladder can be filled to the desired extent with water, air being expelled to the environment. Since the container is generally rigid, is within the rigid enclosure, and since both volumes are kept at a constant differential pressure relative to ambient pressure, the size of the container will remain the same regardless of the pressure exerted by varying depths of water. With a fixed size, the weight is variable by only the amount of water in the bladder (the weight of the air being negligible). As a result, the buoyancy can be set by the diver, and it will not change due to changes in depth.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
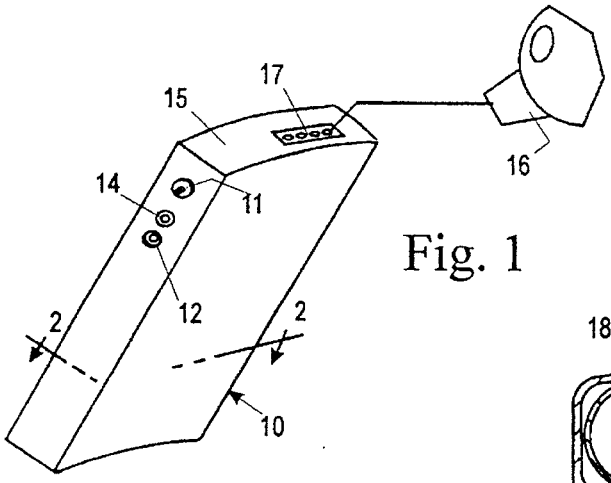
FIG. 1 is a perspective view showing a device made in accordance with the present invention, and including a mask shown schematically.

Referring now more particularly to the drawings, and to those embodiments of the invention here chosen by way of illustration, FIG. 1 shows an enclosure generally designated at 10. There may be a pressure relief valve 11 to maintain a fixed pressure within the enclosure, and a fill valve 12 and a control valve 14. The upper surface 15 of the enclosure 10 mounts a connector block 17 having a plurality of connectors, for example for connection of the primary demand regulator 16. Other equipment can be supplied with air from the connector block 17 as desired.

Figure 2:
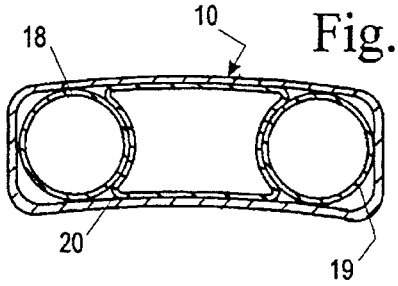
FIG. 2 is an enlarged cross-sectional view taken along the line 2—2 in FIG. 1.

It will be noticed that the enclosure 10 is generally rectangular, and slightly curved to fit a person's back, as is better shown in FIG. 2. Those skilled in the art will understand that the size and the relative dimensions are variable to suit the particular application. Also, the shape can be changed somewhat to streamline the shape for less drag as the diver moves through the water.

Turning to FIG. 2 of the drawings, it will be seen that this embodiment of the invention includes two air tanks 18 and 19. From the above discussion, it will of course be understood that the tanks 18 and 19 are light-weight tanks, having an inner shell of aluminum or the like, and an outside winding of fiber encased in a binder resin. As shown in FIG. 2, the two tanks 18 and 19 are spaced apart within the enclosure 10, leaving a void between the two tanks. That void is here shown as receiving a container 20. The details are not shown in FIG. 2, but the container 20 may be used in the buoyancy control. If preferred, the enclosure 10 may be made smaller to omit the container 20 and the buoyancy control. One would still have the advantage of the light-weight tanks for less weight with greater air capacity.

Figure 3:
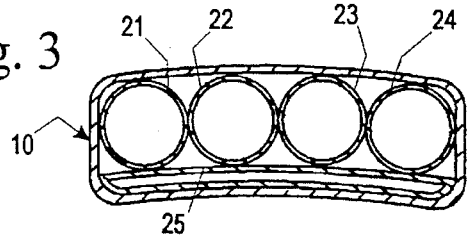
FIG. 3 is a view similar to FIG. 2 but showing a modified form of the invention.

FIG. 3 shows another form of apparatus for the present invention. The enclosure 10 is the same as in FIGS. 1 and 2, but there are four air tanks 21, 22, 23 and 24. The tanks 21–24 are smaller in diameter than the tanks 18 and 19, so all four can be disposed side by side within the enclosure 10. In the arrangement shown in FIG. 3, then, there is a void at one side of the enclosure, the void receiving a container 25. It will be noticed that the container 25 extends the full width of the enclosure 10.

It will therefore be understood that the interior of the enclosure 10 can be arranged in many different ways. If no buoyancy control is desired, the enclosure can be shaped to be filled by the air tanks. If the buoyancy control is desired, the tanks can be arranged in any way desired so long as there is a space to receive the container, such as the container 20 or 25, for use in the buoyancy control. In all cases, the enclosure 10 protects the light-weight air tanks from exposure to water so the apparatus can be used as a scuba system.

Figure 4:
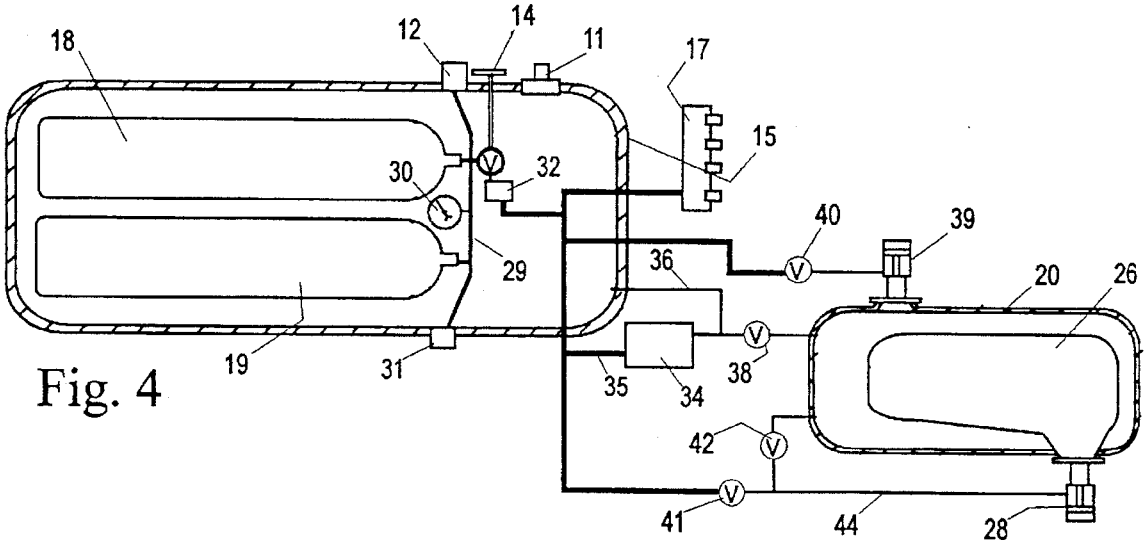
FIG. 4 is a schematic diagram showing the apparatus of the present invention, with two air tanks and controls; and, FIG. 5 is a view similar to FIG. 4 but showing apparatus having four air tanks and controls.

FIG. 4 of the drawings is a schematic diagram illustrating the apparatus shown in FIG. 2. Thus, the reference numerals used in FIG. 2 are applied to the same parts in FIG. 4. The container 20 is shown separated from the enclosure 10 for clarity, and it will be seen that there is a flexible bladder 26 within the container 20, the bladder 26 being selectively in communication with the water through a valve 28.

Considering the enclosure 10 in more detail, the two tanks 18 and 19 are connected to a manifold 29 which is connected to a main valve operated by the handle 14. A gauge 30 may be connected to the manifold 29. One end of the manifold 29 extends through the enclosure 10 to provide the cylinder filling valve 12. The valve 12 will preferably include a check valve. The opposite end of the manifold 29 extends through the enclosure 10 to provide a burst disk 31 to protect against excess pressure in the tanks 18 and 19.

Within the enclosure 10, the main pressure reducer 32 is connected to the main valve, the pressure reducer 32 reducing the tank pressure to an intermediate pressure which is fed to the connector block 17 and to control means which will be discussed below.

There is a housing regulator 34 which receives the intermediate pressure from the line 35 and reduces the pressure to the pressure desired for the interior of the enclosure 10, which may be about 1 p.s.i above ambient pressure. Air from the regulator 34 is then fed to the enclosure 10 through the line 36. Air from the regulator 34 can also be directed to the container 20 through normally open valve 38.

The container 20 has a vent valve 39 to vent the interior thereof to the atmosphere. By opening the valve 40, air will be fed to the valve, which will cause the valve 39 to open and allow air within the container 20 to be expelled. Air can be introduced to the container 20 by opening the valves 41 and 42. Air through the line 44 will often the valve 28 so the contents of the bladder 26 can be expelled by air introduced through the valve 42.

With the foregoing description in mind, it should be understood that a diver will enter the water, and open the valve 41 to open the valve 28 so water can enter the bladder 26. The valve 40 will also be opened to allow air in the container 20 to be expelled. When the desired amount of water has entered the bladder 26, valves 41 and 40 will be closed. Thus, the size of the apparatus is fixed, and cannot change even at great depths; and, the weight of the apparatus is fixed because the amount of water in the bladder 26 cannot change. The space in the container 20 not occupied by the bladder 26 will be filled with air. Even though the quantity of the air will vary, the weight of the air is negligible. As a result, the buoyancy of the apparatus will remain constant, regardless of the depth.

One of the primary purpose of the enclosure 10 is to protect the light-weight cylinders 18 and 19 from exposure to water. In view of this, the pressure within the enclosure 10 is maintained above ambient pressure to prevent seepage. Since the interior of the enclosure is always above ambient pressure, air will be expelled and water cannot enter. The pressure is maintained by the pressure regulator which requires the pressure through the line 36.

Figure 5:
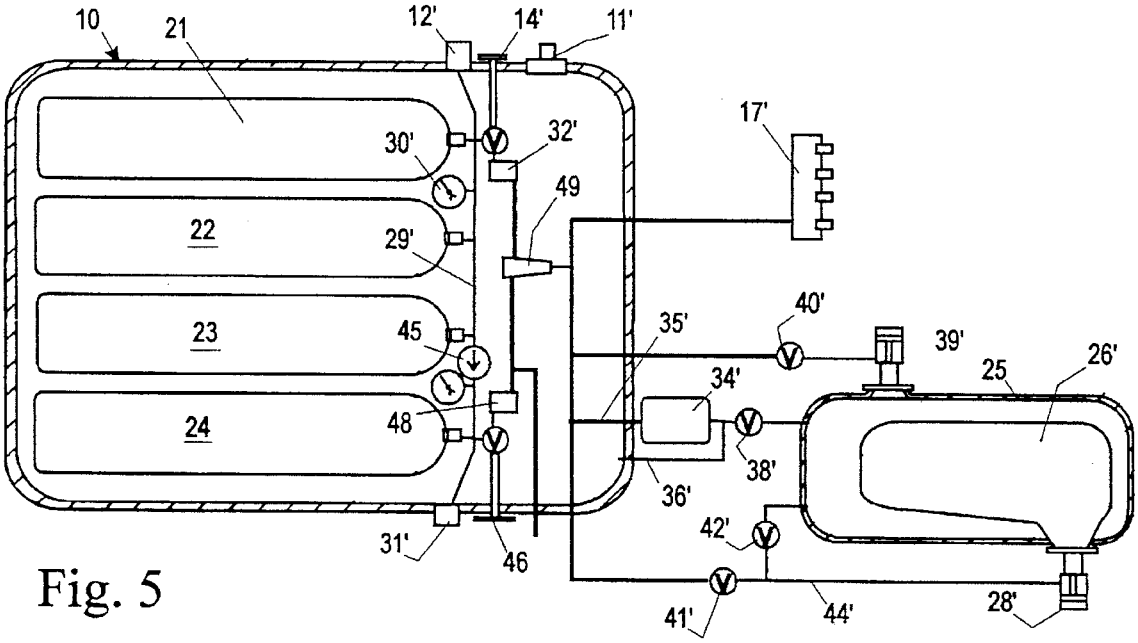

FIG. 5 of the drawings illustrates the control system for the four-tank apparatus shown in FIG. 3. The buoyancy control system is the same as that just described, and the description will not be repeated. Primes of the numerals in FIG. 4 have been applied to comparable parts in FIG. 5.

Since the embodiment of the invention shown in FIG. 5 includes four separate air tanks, it is possible to utilize one of the tanks as a backup cylinder. As shown, tank 24 used as a backup. It will be seen that the manifold 29' includes a check valve 45 which prevents flow from the tank 24 into the manifold 29'. There is, then, a backup main valve controlled by the handle 46. The backup main valve is connected to a backup reducer 48, which is connected to an automatic reserve air switch (ARAS) 49. The ARAS is known to those skilled in the art, and automatically switches to the reserve, or backup tank, when the pressure in the main tanks is too low. It will be readily seen that the ARAS could be omitted and the change-over handled manually.

While many variations and specific designs of the apparatus of the present invention are possible, the following will illustrate the weight advantages of the present invention with the two embodiments disclosed herein:

| | Standard Tank System | 2 Lt.-Wt. Tanks | 4 Lt.-Wt. Tanks |
|---|---|---|---|
| Tank Diameter | 7.5" | 5.8" | 4.6" |
| Filled Weight | 50 lbs. | 32 lbs. | 26 lbs. |
| Filled Volume | 80 cu.ft. | 90 cu.ft. | 92 cu.ft. |

It will therefore be seen that the apparatus of the present invention can provide a greater quantity of air with significantly less weight. The addition of the automatic buoyancy control renders the device highly superior to the prior art scuba systems.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. Scuba apparatus comprising at least one light-weight air tank consisting of an aluminum tank wrapped with fibers in a resin binder, a watertight enclosure, said air tank being received within said enclosure, means for pressurizing the interior of said enclosure for excluding water from said enclosure, and connection means for connecting the air within said air tank with a scuba mask.

2. Scuba apparatus as claimed in claim 1, wherein said at least one light-weight air tank comprises a plurality of air tanks, a manifold connecting said plurality of air tanks, and a fill valve extending through said enclosure and communicating with said manifold.

3. Scuba apparatus as claimed in claim 2, wherein said plurality of air tanks comprises four air tanks adjacent to one another within said enclosure and defining a void between said tanks and one wall of said enclosure, and buoyancy adjusting means received within said void.

4. Scuba apparatus as claimed in claim 3, said buoyancy adjusting means comprising a container within said void, a flexible bladder received within said container, valve means for selectively allowing water to flow into said flexible bladder, and vent means for allowing the escape of air within said container and outside said bladder.

5. Scuba apparatus as claimed in claim 4, wherein one tank of said four tanks comprises a back-up tank and the remaining three tanks comprise the main tanks, said apparatus including a check valve in said manifold for isolating said back-up tank from said main tanks, a main reducer for reducing the pressure in said main tanks to an intermediate pressure, and a back-up reducer for reducing the pressure in said back-up tank to said intermediate pressure.

6. Scuba apparatus as claimed in claim 5, and further including means for determining when said main tanks have low pressure, and for supplying air from said back-up tank in response to such determination.

7. Scuba apparatus as claimed in claim 2, wherein said plurality of air tanks comprises two air tanks spaced apart within said enclosure and defining a void between said tanks, and buoyancy adjusting means received within said void.

8. Scuba apparatus as claimed in claim 7, said buoyancy adjusting means comprising a container within said void, a flexible bladder received within said container, valve means for selectively allowing water to flow into said flexible bladder, and vent means for allowing the escape of air within said container and outside said bladder.

9. Scuba apparatus as claimed in claim 1, and further including a container within said enclosure, a flexible bladder received within said container, valve means for selectively allowing water to flow into said flexible bladder, and vent means for allowing the escape of air within said container and outside said bladder.

* * * * *